US012025112B2

(12) United States Patent
Koide et al.

(10) Patent No.: US 12,025,112 B2
(45) Date of Patent: Jul. 2, 2024

(54) PISTON BODY INCLUDING AN INTERNAL SPACE FOR USE IN A HYDRAULIC PUMP OR MOTOR

(71) Applicant: Komatsu Ltd., Tokyo (JP)

(72) Inventors: Shunsuke Koide, Tokyo (JP); Hiroaki Motoshima, Tokyo (JP); Shigeyoshi Kawakita, Tokyo (JP)

(73) Assignee: Komatsu Ltd., Tokyo (JP)

( * ) Notice: Subject to any disclaimer, the term of this patent is extended or adjusted under 35 U.S.C. 154(b) by 326 days.

(21) Appl. No.: 17/288,149

(22) PCT Filed: Nov. 15, 2019

(86) PCT No.: PCT/JP2019/044946
§ 371 (c)(1),
(2) Date: Apr. 23, 2021

(87) PCT Pub. No.: WO2020/101027
PCT Pub. Date: May 22, 2020

(65) Prior Publication Data

US 2022/0010786 A1 Jan. 13, 2022

(30) Foreign Application Priority Data

Nov. 15, 2018 (JP) ..... 2018-214943

(51) Int. Cl.
*F04B 1/12* (2020.01)

(52) U.S. Cl.
CPC ..... *F04B 1/12* (2013.01)

(58) Field of Classification Search
CPC .... F04B 1/12; F04B 1/20; F04B 53/18; F04B 1/124; F04B 53/14; F03C 1/0605; F03C 1/0636; F01B 3/0085; F01B 3/0079; B23P 15/10; Y10T 29/49252; Y10T 29/49249; F16J 1/08; F16J 1/09
USPC ..... 91/488, 181 R; 92/181 R, 158, 172; 29/888.04, 888.042, 888.044
See application file for complete search history.

(56) References Cited

U.S. PATENT DOCUMENTS 2,880,042 A * 3/1959 Budzich ..... F01B 3/0085 91/488
3,106,138 A * 10/1963 Thoma ..... F01B 3/0085 184/18
3,120,816 A * 2/1964 Firth ..... F16C 32/0666 91/488
3,153,987 A * 10/1964 Thoma ..... F16J 1/22 92/158

(Continued)

FOREIGN PATENT DOCUMENTS

CN 1294036 A 5/2001
CN 103711689 A 4/2014

(Continued)

OTHER PUBLICATIONS

Office Action dated May 10, 2024, issued in the corresponding German patent application No. 112019004123.7.

*Primary Examiner* — Devon C Kramer
*Assistant Examiner* — Benjamin Doyle
(74) *Attorney, Agent, or Firm* — Locke Lord LLP

(57) ABSTRACT

A piston is provided with a piston body that includes an internal space and a leading end member that includes an insertion portion placed in the internal space and a protrusion protruding from a leading end surface of the piston body.

10 Claims, 5 Drawing Sheets

(56) References Cited

U.S. PATENT DOCUMENTS

| | | | | | |
|---|---|---|---|---|---|
| 3,187,644 | A * | 6/1965 | Ricketts | F01B 3/0008 | 92/147 |
| 3,188,973 | A * | 6/1965 | Firth | F01B 3/0085 | 91/488 |
| 3,216,333 | A * | 11/1965 | Thoma | F04B 1/124 | 92/110 |
| 3,367,277 | A | 2/1968 | Andrews et al. | | |
| 3,633,467 | A * | 1/1972 | Watanabe | F04B 1/124 | 264/269 |
| 3,741,077 | A * | 6/1973 | Hulsebus | F04B 1/124 | 92/158 |
| 3,828,654 | A * | 8/1974 | Wiethoff | F04B 1/124 | 92/158 |
| 4,216,704 | A * | 8/1980 | Heyl | F01B 3/0085 | 92/158 |
| 4,454,802 | A * | 6/1984 | Cailliau | F04B 1/0408 | 92/158 |
| 5,072,655 | A * | 12/1991 | Adler | F04B 1/124 | 92/158 |
| 5,216,943 | A * | 6/1993 | Adler | B22D 19/0027 | 29/888.047 |
| 5,265,331 | A * | 11/1993 | Engel | F04B 1/124 | 92/260 |
| 5,642,654 | A * | 7/1997 | Parekh | B23P 15/10 | 92/260 |
| 6,250,206 | B1 * | 6/2001 | Johnson | F04B 1/124 | 92/158 |
| 6,314,864 | B1 * | 11/2001 | Beck | F01B 3/0085 | 92/260 |
| 6,318,242 | B1 * | 11/2001 | Stoppek | F04B 53/14 | 92/187 |
| 6,662,709 | B1 * | 12/2003 | Beutler | F04B 1/124 | 92/260 |
| 6,703,577 | B2 * | 3/2004 | Stoppek | B23K 11/14 | 219/104 |
| 2002/0096047 | A1 | 7/2002 | Stoppek | | |
| 2005/0284289 | A1 * | 12/2005 | Rober | B23P 15/10 | 92/187 |
| 2016/0273653 | A1 * | 9/2016 | Tamashima | F04B 53/08 | |
| 2021/0148342 | A1 * | 5/2021 | Andersen | F03C 1/0605 | |

FOREIGN PATENT DOCUMENTS

| | | | |
|---|---|---|---|
| CN | 206785575 | U | 12/2017 |
| DE | 1528408 | A1 | 7/1969 |
| DE | 4301140 | A1 | 9/1993 |
| DE | 19620167 | C1 | 3/1997 |
| JP | S49-54902 | A | 5/1974 |
| JP | H05-269628 | A | 10/1993 |
| JP | H11-62850 | A | 3/1999 |
| JP | 2010-196614 | A | 9/2010 |
| JP | 2014-152690 | A | 8/2014 |

* cited by examiner

PISTON BODY INCLUDING AN INTERNAL SPACE FOR USE IN A HYDRAULIC PUMP OR MOTOR

FIELD

The present invention relates to a piston and a hydraulic pump or motor.

BACKGROUND

A variable displacement hydraulic pump or motor is provided with a cylinder block including a plurality of cylinders, a plurality of pistons respectively placed in the plurality of cylinders, and a swash plate that supports the pistons via piston shoes. The rotation of the cylinder block causes the pistons and piston shoes to swing with the piston shoes sliding on the swash plate. With the piston shoes sliding on the swash plate, the swing of the pistons and piston shoes causes the pistons to reciprocate inside the cylinders. The reciprocation of the pistons changes stroke volumes defined between the pistons and the cylinders.

CITATION LIST

Patent Literature

Patent Literature 1: JP 2014-152690 A

SUMMARY

Technical Problem

Reducing the weight of a piston enables the piston to swing and reciprocate at high speed. On the other hand, when the inside of the piston is hollowed to reduce the weight of the piston, a hydraulic pump or motor increases in dead volume. Furthermore, in regard to a cylinder, shaping the side closer to the top dead center into a cone facilitates the workability during machining of the cylinder. On the other hand, shaping the side of the cylinder closer to the top dead center into a cone increases the dead volume. The dead volume is a space defined between the cylinder and the piston when the piston is placed at the top dead center that indicates a position when the piston enters the cylinder to a maximum extent. The dead volume is a space that does not contribute to changes in stroke volume. A large dead volume requires extra work for compressing the dead volume. Therefore, a large dead volume deteriorates the efficiency of the hydraulic pump or motor.

An aspect of the present invention is to reduce a dead volume of a hydraulic pump or motor.

Solution to Problem

According to an aspect of the present invention, a piston comprises: a piston body including an internal space; and a leading end member including an insertion portion placed in the internal space and a protrusion protruding from a leading end surface of the piston body.

DESCRIPTION OF EMBODIMENTS

Hereinafter, embodiments of the present invention will be described with reference to the drawings, but the present invention is not limited thereto. Components of the following embodiments can be combined as appropriate. Furthermore, some components may not be used.

First Embodiment

<Hydraulic Pump or Motor>

Figure 1:
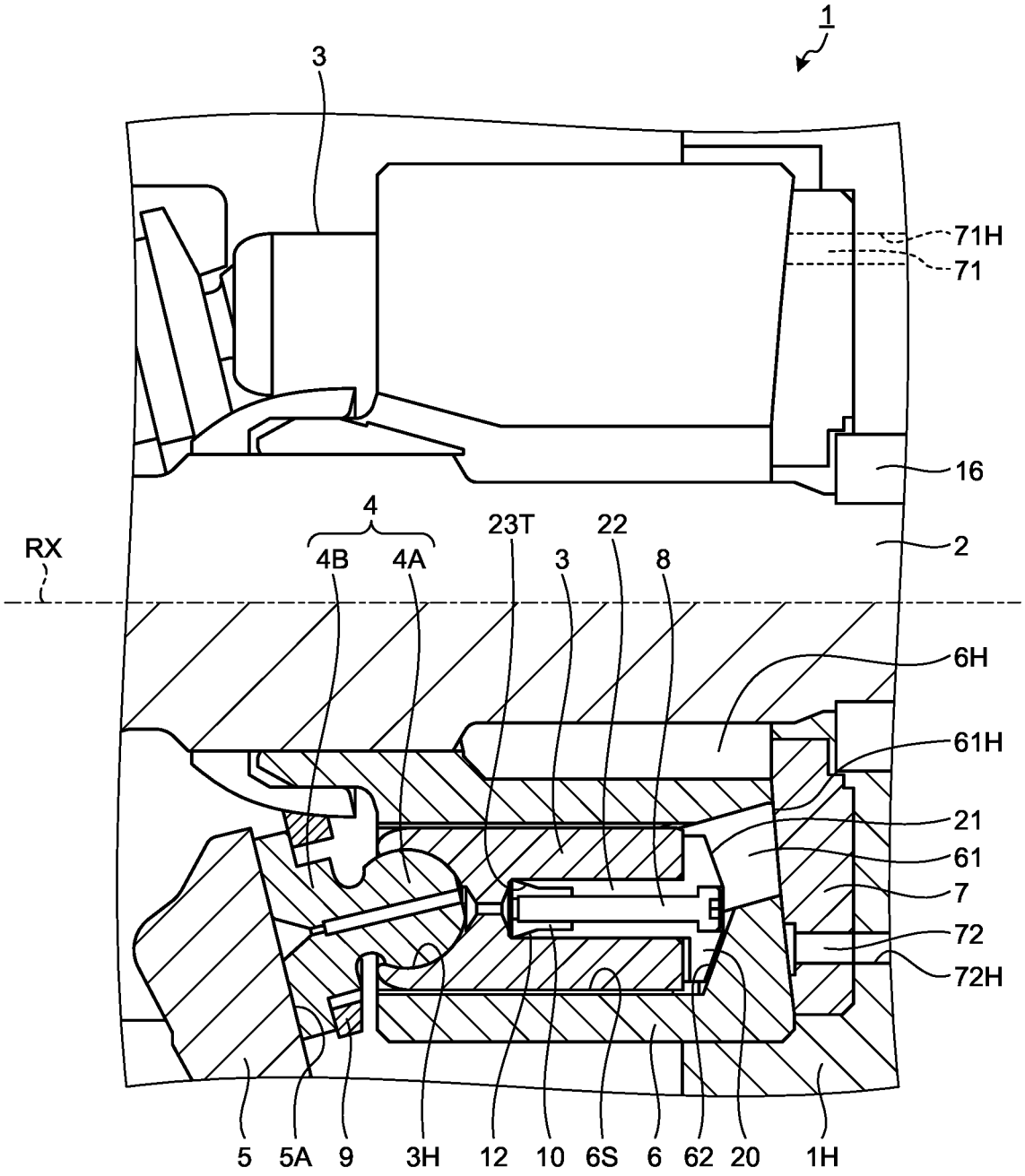
FIG. 1 is a view illustrating an example of a hydraulic pump or motor according to a first embodiment.

A first embodiment will now be described. FIG. 1 is a view illustrating an example of a hydraulic pump or motor 1 according to this embodiment. In this embodiment, the hydraulic pump or motor 1 operates as a hydraulic pump. In the following description, the hydraulic pump or motor 1 is conveniently referred to as "hydraulic pump 1".

As illustrated in FIG. 1, the hydraulic pump 1 includes a housing 1H, a drive shaft 2, a cylinder block 6 placed around the drive shaft 2 and having a plurality of cylinders 6S, a plurality of pistons 3 respectively placed in the plurality of cylinders 6S, piston shoes 4 respectively disposed at base ends of the pistons 3, a swash plate 5 that supports the piston shoes 4, and a valve plate 7 facing the cylinder block 6.

The drive shaft 2 rotates about a rotation axis RX. The drive shaft 2 is rotatably supported by a bearing 16. The drive shaft 2 is rotated by power generated by a power source such as an engine.

The cylinder block 6 is placed around the drive shaft 2. The cylinder block 6 is placed inside the housing 1H. The cylinder block 6 is a cylindrical member. At least a part of the drive shaft 2 is placed in a center hole 6H of the cylinder block 6. The cylinder block 6 is fixed to the drive shaft 2. The cylinder block 6 and the drive shaft 2 are connected by, for example, a spline coupling. The rotation of the drive shaft 2 causes the cylinder block 6 to rotate about the central axis RX together with the drive shaft 2.

The cylinders 6S are spaces in which the pistons 3 are placed respectively. The plurality of cylinders 6S is disposed around the central axis RX. The plurality of cylinders 6S is placed at regular intervals around the central axis RX. The cylinders 6S have a circular shape in a cross section perpendicular to the rotation axis RX. A leading end of each cylinder 6S is connected to an opening 61H disposed on a leading end surface of the cylinder block 6 via a communication port 61. Each communication port 61 has a smaller inner diameter than each cylinder 6S. Each cylinder 6S has an opposed surface 62 that faces at least a part of a leading end of each piston 3.

The pistons 3 reciprocate inside the cylinders 6S in a direction parallel to the rotation axis RX. The reciprocation of the pistons 3 changes stroke volumes defined between the pistons 3 and the cylinders 6S.

Each piston shoe 4 is disposed at the base end of each piston 3. Each piston shoe 4 includes a spherical portion 4A connected to each piston 3, and a leg portion 4B that comes into contact with the swash plate 5. A plurality of piston shoes 4 is held by a retainer 9.

Each spherical portion 4A is placed in a spherical space 3H disposed at the base end of each piston 3. Each spherical portion 4A is placed in each space 3H by crimping at least a part of each piston 3. The spherical portions 4A are rotatable inside the spaces 3H. The spherical portions 4A and the pistons 3 can move relative to each other.

The swash plate 5 is placed around the drive shaft 2. The swash plate 5 supports the plurality of piston shoes 4. The swash plate 5 includes a sliding surface 5A that comes into contact with the leg portion 4B of each piston shoe 4. The swash plate 5 can be inclined with respect to the rotation axis RX. An actuator for driving the swash plate 5 generates power to adjust an angle of inclination of the swash plate 5 with respect to the rotation axis RX.

The valve plate 7 faces the leading end surface of the cylinder block 6. The valve plate 7 includes an intake port 71 and a discharge port 72. The intake port 71 is connected to an intake passage 71H disposed in the housing 1H. The intake port 71 is connected to a hydraulic oil tank via the intake passage 71H. The discharge port 72 is connected to a discharge passage 72H disposed in the housing 1H. The discharge port 72 is connected to a hydraulic oil supply target via the discharge passage 72H. An example of the hydraulic oil supply target includes a hydraulic cylinder that drives working equipment of a construction machine.

Piston

Figure 2:
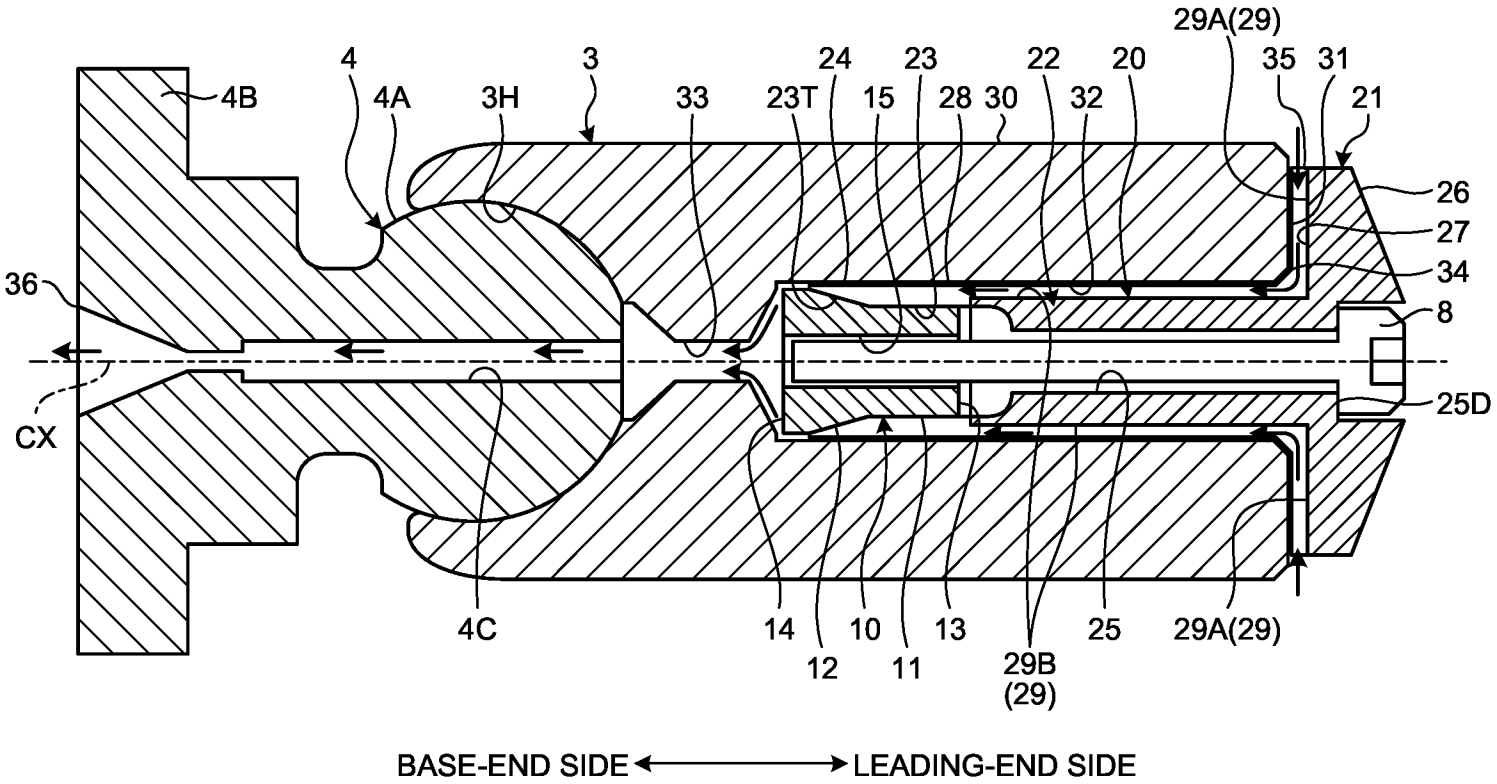
FIG. 2 is a cross-sectional view illustrating an example of a piston according to the first embodiment.

FIG. 2 is a cross-sectional view illustrating an example of a piston 3 according to this embodiment. As illustrated in FIG. 2, the piston 3 is provided with a piston body 30 which includes an internal space 32, and a leading end member 20 which includes an insertion portion 22 placed in the internal space 32 and a protrusion 21 protruding from a leading end surface 31 of the piston body 30.

The piston 3 is also provided with a connection member 10 which is placed in the internal space 32 of the piston body 30 and connected to the insertion portion 22, and a bolt 8 which connects the leading end member 20 and the connection member 10.

The piston body 30 is a substantially cylindrical member. A central axis CX of the piston body 30 and the rotation axis RX are substantially parallel. In the following description, a direction parallel to the central axis CX of the piston body 30 is conveniently referred to as "axial direction", a radiation direction of the central axis CX of the piston body 30 is conveniently referred to as "radiation direction", and a direction of rotation about the central axis CX of the piston body 30 is conveniently referred to as "circumferential direction".

Furthermore, in the axial direction, a direction toward the valve plate 7 or a position close to the valve plate 7 is conveniently referred to as "leading-end side", and a direction toward the swash plate 5 or a position close to the swash plate 5 is conveniently referred to as "base-end side". The leading-end side indicates a direction toward the top dead center or a position close to the top dead center. The base-end side indicates a direction toward the bottom dead center or a position closer to the bottom dead center. The top dead center indicates a position of the piston 3 when the piston 3 enters the corresponding cylinder 6S to a maximum extent. The bottom dead center indicates a position of the piston 3 when the piston 3 retracts from the cylinder 6S to a maximum extent.

The piston body 30 includes a metal. For example, the piston body 30 includes a low-alloy steel such as chrome molybdenum steel. In this embodiment, the specific gravity of a material included in the piston body 30 is 7.8. Note that the specific gravity of a material indicates the mass [t] of the material per 1 [$m^3$].

The piston body 30 includes the internal space 32 and an internal channel 33 disposed closer to the base-end side than the internal space 32. The internal space 32 is connected to an opening 34 formed on the leading end surface 31.

The internal space 32 extends in the axial direction. The internal space 32 includes the central axis CX. In a cross section perpendicular to the central axis CX, the internal space 32 has a circular shape. In the cross section perpendicular to the central axis CX, the center of the internal space 32 and the central axis CX agree with each other.

The internal channel 33 is connected to a base end of the internal space 32. The internal channel 33 connects the internal space 32 and the space 3H.

The leading end surface 31 is placed around the opening 34 of the piston body 30 connected to a leading end of the internal space 32. In the cross section perpendicular to the central axis CX, the leading end surface 31 has an annular shape. The leading end surface 31 is flat. The leading end surface 31 is parallel to the cross section perpendicular to the central axis CX.

Figure 3:
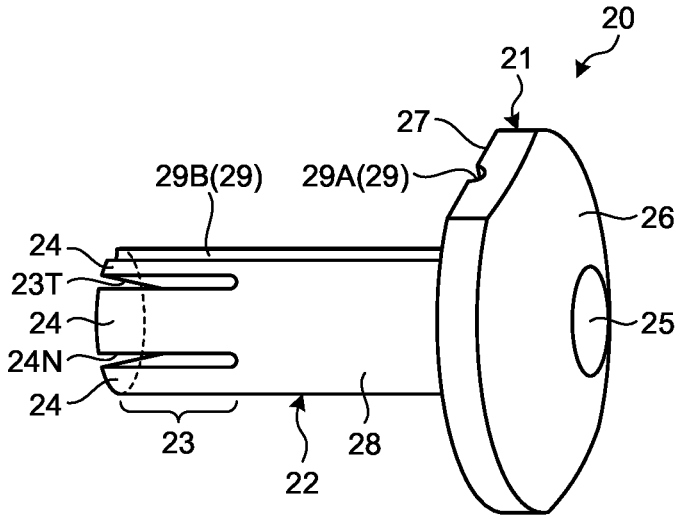
FIG. 3 is a perspective view illustrating a leading end member according to the first embodiment.

FIG. 3 is a perspective view illustrating the leading end member 20 according to this embodiment. As illustrated in FIGS. 2 and 3, the leading end member 20 includes the insertion portion 22 placed in the internal space 32 and the protrusion 21 protruding from the leading end surface 31 toward the leading-end side. In the cross section perpendicular to the central axis CX, the outer shape of the protrusion 21 is larger than that of the insertion portion 22.

The leading end member 20 has a through hole 25 parallel to the central axis CX of the piston body 30. The through hole 25 connects an end face of the protrusion 21 on the leading-end side and an end face of the insertion portion 22 on the base-end side. In the cross section perpendicular to the central axis CX, the through hole 25 has a circular shape. In the cross section perpendicular to the central axis CX, the center of the through hole 25 and the central axis CX agree with each other.

The protrusion 21 is placed closer to the leading-end side than the leading end surface 31. The protrusion 21 includes a surface 26 facing the leading-end side and an opposed surface 27 facing the leading end surface 31.

The surface 26 of the protrusion 21 is inclined to approach the central axis AX while getting farther from the leading end surface 31 in the axial direction. In this embodiment, the surface 26 is linear in a cross section including the central axis CX. In other words, the surface 26 has a tapered shape with an outer diameter gradually decreasing toward the leading-end side.

As illustrated in FIG. 1, the surface 26 of the leading end member 20 and the opposed surface 62 of the cylinder 6S are substantially parallel to each other.

In the radiation direction, the surface 26 of the protrusion 21 is placed inside the outer periphery of the piston body 30. In other words, the protrusion 21 is provided not to protrude from the outer periphery of the piston body 30 in the radiation direction.

The opposed surface 27 faces the leading end surface 31. When viewed from the axial direction, the opposed surface 27 has an annular shape. The opposed surface 27 is flat. The leading end surface 31 and the opposed surface 27 are parallel. The leading end surface 31 and at least a part of the opposed surface 27 are in contact with each other.

The insertion portion 22 has a cylindrical shape. The insertion portion 22 is inserted into the internal space 32.

The insertion portion 22 has an outer surface 28 facing an inner surface of the internal space 32. The inner surface of the internal space 32 and at least a part of the outer surface 28 of the insertion portion 22 are in contact with each other.

In regard to the through hole 25 of the insertion portion 22, an inner diameter on the base-end side is larger than an inner diameter on the leading-end side. In the through hole 25 of the insertion portion 22, the connection member 10 is stored on the base-end side. In the following description, a part of the through hole 25 on the base-end side having an inner diameter capable of storing the connection member 10 is conveniently referred to as "storage space 23".

The insertion portion 22 is placed around the connection member 10 and includes deformable portions 24 elastically deformable in the radiation direction. The storage space 23 is defined by the inner side of the deformable portions 24. As illustrated in FIG. 3, notches 24N are formed at a base end of the insertion portion 22. A plurality of notches 24N is disposed in the circumferential direction. One deformable portion 24 is disposed between adjacent notches 24N. A plurality of deformable portions 24 is disposed in the circumferential direction. Due to the notches 24N, the deformable portions 24 can elastically deform in the radiation direction.

In addition, at least a part of the inner surface of the storage space 23 includes a slope 23T inclined with respect to the central axis CX. The slope 23T is inclined from an end of the storage space 23 on the base-end side toward the leading-end side so as to approach the central axis CX. In other words, the slope 23T has a tapered shape with an inner diameter gradually decreasing toward the leading-end side.

An outer diameter of at least a part of the connection member 10 is slightly larger than an inner diameter of the storage space 23. When the connection member 10 is placed in the storage space 23 and an outer surface of the connection member 10 comes into contact with the inner surface of the storage space 23, the deformable portions 24 deform outward in the radiation direction. The deformable portions 24 deformed outward in the radiation direction come into contact with the inner surface of the internal space 32 of the piston body 30. When the deformable portions 24 come into contact with the inner surface of the internal space 32 of the piston body 30, the leading end member 20 and the connection member 10 are fixed to the piston body 30.

An oil passage 29 through which hydraulic oil flows is disposed between the leading end surface 31 and at least a part of the opposed surface 27 and between the inner surface of the internal space 32 and at least a part of the outer surface 28 of the insertion portion 22. As illustrated in FIG. 3, a channel groove 29A is formed on a part of the opposed surface 27. A channel groove 29B is formed on a part of the outer surface 28. The channel groove 29A and the channel groove 29B are connected to each other. The oil passage 29 is defined between the channel groove 29A and the leading end surface 31 and between the channel groove 29B and the inner surface of the internal space 32. A base end of the oil passage 29 is connected to the internal channel 33. An inlet 35 is disposed between an outer end of the channel groove 29A in the radiation direction and an outer end of the leading end surface 31 in the radiation direction. The hydraulic oil flows into the oil passage 29 through the inlet 35. The hydraulic oil flowing through the oil passage 29 is supplied to an internal channel 4C disposed in the piston shoe 4 via the internal channel 33. The internal channel 4C connects a leading end of the spherical portion 4A and a base end of the leg portion 4B. An outlet 36 for hydraulic oil is provided at a base end of the internal channel 4C. The hydraulic oil flowing through the internal channel 4C is supplied between the piston shoe 4 and the swash plate 5 via the outlet 36.

The leading end member 20 is smaller than the piston body 30 in density. The leading end member 20 includes a metal. A material for the leading end member 20 exemplified is at least one of cast iron (specific gravity 7.2), zinc (specific gravity 7.2), titanium (specific gravity 4.5), and aluminum (specific gravity 2.7). The leading end member 20 may include synthetic resin. A material for the leading end member 20 exemplified is at least one of MC nylon (specific gravity 1.2), polyacetal resin (specific gravity 1.4), ultra high molecular weight polyethylene (specific gravity 1.0), fluororesin (specific gravity 2.2), polyether ether ketone (specific gravity 1.3), and acrylonitrile-butadiene-styrene copolymer synthetic resin (specific gravity 1.1). Note that the leading end member 20 may have a density equal to that of the piston body 30.

Figure 4:
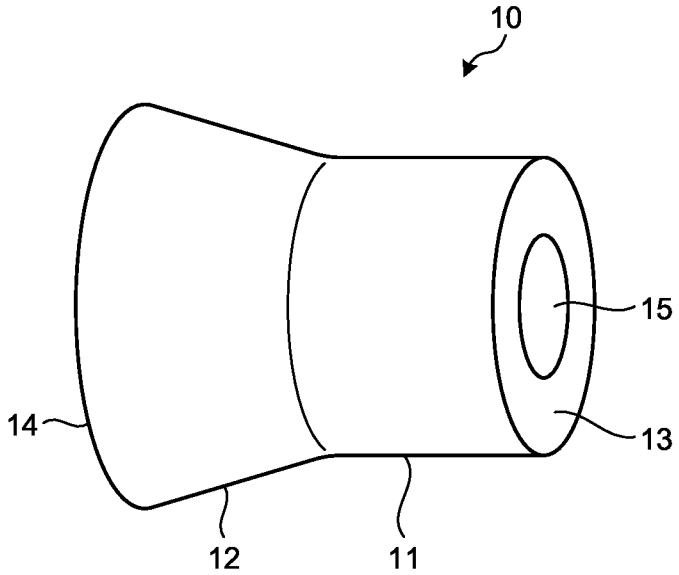
FIG. 4 is a perspective view illustrating a connection member according to the first embodiment.

FIG. 4 is a perspective view illustrating the connection member 10 according to this embodiment. As illustrated in FIGS. 2 and 4, the connection member 10 is a tubular member. The connection member 10 is placed in the storage space 23 of the insertion portion 22 in the internal space 32. The outer surface of the connection member 10 and the inner surface of the storage space 23 face each other.

At least a part of the outer surface of the connection member 10 is inclined to approach the central axis CX while getting closer to the leading end surface 31 in the axial direction.

In this embodiment, the connection member 10 includes a cylindrical portion 11 and a tapered portion 12 placed on the base-end side of the cylindrical portion 11. In the cross section perpendicular to the central axis CX, the outer shape of the tapered portion 12 is larger than that of the cylindrical portion 11.

The cylindrical portion 11 has an end face 13 on the leading-end side. In a cross section parallel to the central axis CX, an outer surface of the cylindrical portion 11 is parallel to the central axis CX. The tapered portion 12 has an end face 14 on the base-end side.

An outer surface of the tapered portion 12 is inclined to approach the central axis CX from the boundary with the end face 14 toward the leading-end side. In other words, the tapered portion 12 has a tapered shape with an outer diameter gradually decreasing toward the leading-end side.

The outer diameter of at least a part of the tapered portion 12 is larger than the inner diameter of the storage space 23. The outer surface of the tapered portion 12 comes into contact with the slope 23T of the storage space 23.

The connection member 10 includes a screw hole 15 parallel to the central axis CX. A thread groove is formed on an inner surface of the screw hole 15. The screw hole 15 connects the end face 13 and the end face 14. In the cross section perpendicular to the central axis CX, the screw hole 15 is substantially circular. In the cross section perpendicular to the central axis CX, the center of the screw hole 15 and the central axis CX agree with each other.

The connection member 10 is smaller than the piston body 30 in density. The connection member 10 includes a metal. A material for the connection member 10 may be the same as or different from the material for the leading end member 20. A material for the connection member 10 exemplified is at least one of cast iron (specific gravity 7.2), zinc (specific gravity 7.2), titanium (specific gravity 4.5), and aluminum (specific gravity 2.7). The connection member 10 may include synthetic resin. A material for the connection member 10 exemplified is at least one of MC nylon (specific gravity 1.2), polyacetal resin (specific gravity 1.4), ultra high molecular weight polyethylene (specific gravity 1.0), fluororesin (specific gravity 2.2), polyether ether ketone (specific gravity 1.3), and acrylonitrile-butadiene-styrene copolymer synthetic resin (specific gravity 1.1). Note that the connection member 10 may have a density equal to that of the piston body 30.

The bolt 8 has a shaft placed in the through hole 25, a leading end formed with a thread, and a head. The thread at the leading end of the bolt 8 is coupled to the thread groove of the screw hole 15. A part of the through hole 25 is provided with a stepped portion 25D for supporting the head of the bolt 8.

<Assembly Method>

Hereinafter described is a method for assembling the piston 3 according to this embodiment. Before the connection member 10 and the leading end member 20 are inserted into the internal space 32, the connection member 10 and the leading end member 20 are connected (temporarily assembled) with the bolt 8 involved. In other words, while the slope 23T of each deformable portion 24 of the leading end member 20 is placed around the outer surface of the tapered portion 12 of the connection member 10, the shaft of the bolt 8 is placed in the through hole 25 of the leading end member 20, and the leading end of the bolt 8 is screwed into the screw hole 15 of the connection member 10.

On the outside of the internal space 32, the connection member 10 and the leading end member 20 are connected with the bolt 8 involved. Then, the connection member 10 and the insertion portion 22 of the leading end member 20 are inserted into the internal space 32 from the opening 34. The connection member 10 is inserted into the internal space 32 so that the tapered portion 12 is placed closer to the base-end side than the cylindrical portion 11. The insertion portion 22 is inserted into the internal space 32 so that the deformable portions 24 are placed between the outer surface of the connection member 10 and the inner surface of the internal space 32. The insertion portion 22 is inserted into the internal space 32 so that the leading end surface 31 and the opposed surface 27 come into contact with each other.

In this embodiment, the insertion portion 22 is inserted into the internal space 32 with the slope 23T of each deformable portion 24 placed around the outer surface of the tapered portion 12. When the insertion portion 22 is placed in the internal space 32, the leading end surface 31 of the piston body 30 and the opposed surface 27 of the protrusion 21 face each other.

After the insertion portion 22 of the connection member 10 and the leading end member 20 are placed in the internal space 32, the bolt 8 is rotated so that the bolt 8 is screwed into the screw hole 15. The rotation of the bolt 8 tightens the leading end member 20 on the connection member 10 so that the opposed surface 27 approaches the leading end surface 31 and the end face 13 moves toward the leading-end side.

When the leading end member 20 is tightened on the connection member 10 so that the opposed surface 27 approaches the leading end surface 31 and the end face 13 moves toward the leading-end side, the connection member 10 moves toward the leading-end side with respect to the inner surface of the storage space 23.

The outer diameter of at least a part of the connection member 10 is slightly larger than the inner diameter of the storage space 23. In this embodiment, the outer diameter of at least a part of the tapered portion 12 is larger than the inner diameter of the storage space 23.

While the outer surface of the tapered portion 12 is in contact with the slopes 23T of the storage space 23, the leading end member 20 is tightened on the connection member 10 so that the connection member 10 moves toward the leading-end side with respect to the inner surface of the storage space 23. Accordingly, the deformable portions 24 are deformed outward in the radiation direction together with the movement of the connection member 10. The deformable portions 24 deformed outward in the radiation direction come into contact with the inner surface of the internal space 32 of the piston body 30. When the deformable portions 24 come into contact with the inner surface of the internal space 32 of the piston body 30, the leading end member 20 and the connection member 10 are fixed to the piston body 30.

<Operation>

Hereinafter described is the operation of the hydraulic pump 1. When the drive shaft 2 rotates, the cylinder block 6 rotates around the central axis RX together with the drive shaft 2. The rotation of the cylinder block 6 causes the piston 3 placed in the cylinder 6S and the piston shoe 4 connected to the piston 3 to swing around the central axis RX. The piston shoe 4 swings while sliding on the sliding surface 5A of the swash plate 5. With the piston shoe 4 sliding on the swash plate 5, the swing of the piston shoe 4 causes the piston 3 to reciprocate inside the cylinder 6S. The piston 3 reciprocates between the top dead center that indicates a position where the piston 3 enters the cylinder 6S to a maximum extent and the bottom dead center that indicates a position where the piston 3 retracts from the cylinder 6S to a maximum extent. The reciprocation of the piston 3 changes stroke volumes defined between the piston 3 and the cylinder 6S. When the angle of inclination of the swash plate 5 changes, capacities of the hydraulic pump 1 changes.

The rotation of the cylinder block 6 connects the communication port 61 to at least one of the intake port 71 and the discharge port 72. When the piston 3 moves from the top dead center to the bottom dead center, the communication port 61 and the intake port 71 are connected to each other. The movement of the piston 3 from the top dead center to the bottom dead center draws the hydraulic oil in the hydraulic oil tank into the cylinder 6S via the intake passage 71H and the intake port 71. When the piston 3 moves from the bottom dead center to the top dead center, the communication port 61 and the discharge port 72 are connected to each other. The movement of the piston 3 from the bottom dead center to the top dead center discharges the hydraulic oil of the cylinder 6S to the hydraulic oil supply target via the discharge port 72 and the discharge passage 72H.

When the angle of inclination of the swash plate 5 changes, the reciprocating displacement of the piston 3 associated with the rotation of the cylinder block 6 varies, which causes a change in flow rate of the hydraulic oil discharged to the hydraulic oil supply target via the discharge passage 72H.

At least part of the hydraulic oil of the cylinder 6S flows into the oil passage 29. After flowing through the oil passage 29, the hydraulic oil flows into the internal channel 33 of the piston body 30. The hydraulic oil supplied from the internal channel 33 of the piston body 30 to the internal channel 4C of the piston shoe 4 flows through the internal channel 4C and then through the outlet 36 so that the hydraulic oil is supplied between the base end of the leg portion 4B of the piston shoe 4 and the sliding surface 5A of the swash plate 5. Accordingly, even when the base end of the leg portion 4B and the sliding surface 5A of the swash plate 5 come into contact with each other, a frictional force between the piston shoe 4 and the swash plate 5 is prevented from increasing excessively.

Effect

As described above, according to this embodiment, the piston body 30 is provided with the internal space 32, and the leading end member 20 is configured to close the opening 34 of the internal space 32. The insertion portion 22 of the leading end member 20 is placed in a part of the internal space 32. Such a configuration reduces the weight of the piston 3 while preventing the infiltration of hydraulic oil into the internal space 32. Accordingly, it is possible to reduce the dead volume while reducing the weight of the piston 3. Furthermore, the leading end member 20 includes the protrusion 21 protruding from the leading end surface 31 of the piston body 30 toward the leading-end side. Such a configuration reduces the dead volume when the piston 3 is placed at the top dead center. Accordingly, it is possible to prevent the hydraulic pump 1 from deteriorating in volumetric efficiency.

The surface 26 of the protrusion 21 is inclined to approach the central axis CX while getting farther from the leading end surface 31 toward the leading-end side. As illustrated in FIG. 1, when the cylinder 6S has the opposed surface 62 inclined with respect to the central axis CX, the shape of the surface 26 is determined to be parallel to the opposed surface 62. Accordingly, the dead volume is reduced.

The surface 26 of the protrusion 21 is placed inside the outer periphery of the piston body 30 in the radiation direction. Since the protrusion 21 does not protrude from the piston body 30 in the radiation direction, the protrusion 21 is prevented from coming into contact with the inner surface of the cylinder 6S.

The leading end surface 31 is placed around the opening 34 of the piston body 30 connected to the internal space 32. The protrusion 21 of the leading end member 20 includes the opposed surface 27 facing the leading end surface 31. In other words, in this embodiment, the protrusion 21 has a flange shape extending outward from the insertion portion 22 in the radiation direction. Accordingly, it is possible to reduce the dead volume sufficiently.

The oil passage 29 is disposed between the leading end surface 31 and the opposed surface 27 and between at least a part of the outer surface of the insertion portion 22 and the inner surface of the internal space 32. Accordingly, the hydraulic oil can flow around the outer periphery of the piston body 30, which prevents an excessive increase in temperature on the outer periphery of the piston body 30.

The leading end member 20 is smaller than the piston body 30 in density. Accordingly, it is possible to reduce the piston 3 in weight while maintaining the strength of the piston 3.

The connection member 10 connected to the insertion portion 22 of the leading end member 20 is placed in the internal space 32. The insertion portion 22 includes the deformable portions 24 placed around the connection member 10. The deformable portions 24 are deformed outward in the radiation direction on contact with the connection member 10. Accordingly, simply inserting the connection member 10 inside the deformable portions 24 (inside the storage space 23) makes it possible to deform the deformable portions 24 outward in the radiation direction and to easily fix the connection member 10, the leading end member 20, and the piston body 30.

The connection member 10 includes the tapered portion 12 having the outer surface inclined to approach the central axis AX while getting closer to the leading end surface 31 in the axial direction. Accordingly, when the connection member 10 is to be moved toward the leading-end side to deform the deformable portions 24, it is possible to smoothly move the connection member 10 and smoothly deform the deformable portions 24.

The leading end member 20 includes the through hole 25 parallel to the central axis CX. The connection member 10 includes the screw hole 15 formed with the thread groove. The bolt 8 includes the shaft to be placed in the through hole 25 and the leading end formed with the thread to be connected to the thread groove. With such a configuration, the leading end member 20 can be easily tightened on the connection member 10 by simply rotating the bolt 8.

The connection member 10 is smaller than the piston body 30 in density. Accordingly, it is possible to reduce the piston 3 in weight while maintaining the strength of the piston 3.

Second Embodiment

A second embodiment will now be described. In the following description, components identical or similar to those in the above embodiment are denoted with the same reference numerals, and the description thereof will be simplified or omitted.

Figure 5:
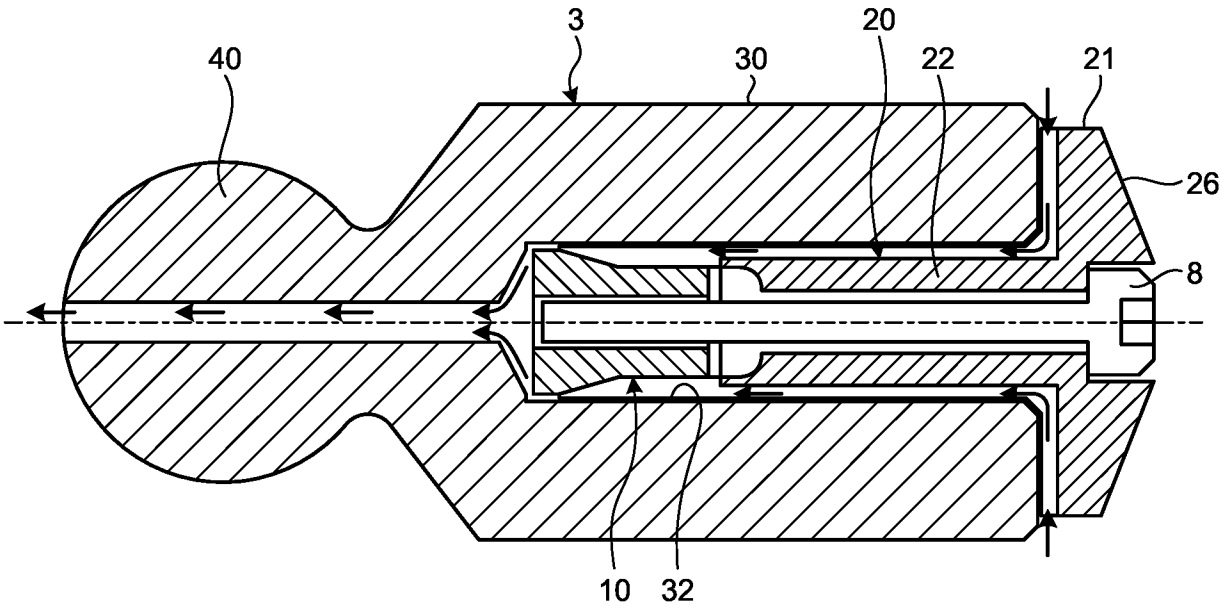
FIG. 5 is a cross-sectional view illustrating an example of a piston according to a second embodiment.

FIG. 5 is a cross-sectional view illustrating an example of a piston 3 according to this embodiment. In the above embodiment, the piston shoe 4 includes the spherical portion 4A, and the piston body 30 includes the space 3H that stores the spherical portion 4A. As illustrated in FIG. 5, a spherical portion 40 may be disposed on a piston body 30. In this case, a piston shoe includes a space that stores the spherical portion 40.

Third Embodiment

Figure 6:
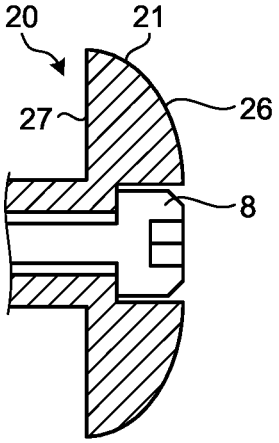
FIG. 6 is a cross-sectional view illustrating a part of a leading end member according to a third embodiment.

A third embodiment will now be described. FIG. 6 is a cross-sectional view illustrating a part of a leading end member 20 according to this embodiment. In the above embodiments, the surface 26 is linear in the cross section perpendicular to the central axis CX. As illustrated in FIG. 6, a surface 26 may be curved in a cross section including the central axis CX. In the example illustrated in FIG. 6, the surface 26 has an arc shape protruding toward the leading-end side.

Other Embodiments

In the above embodiments, the bolt 8 may be provided with an oil passage. Hydraulic oil may be supplied between piston shoes and a swash plate via the oil passage disposed in the bolt 8.

In the above embodiments, the leading end member 20 has a smaller density than the piston body 30, and the connection member 10 has a smaller density than the piston body 30. The leading end member 20 may have a density equal to that of the piston body 30. The connection member 10 may have a density equal to that of the piston body 30. Even in these cases, it is possible to reduce the dead volume.

In the above embodiments, the leading end member 20 is fixed to the piston body 30 via the connection member 10. The connection member 10 may be omitted. For example, a thread is disposed on an outer surface of the insertion portion 22 of the leading end member 20 and a thread groove is disposed on an inner surface of the internal space 32. When the thread and the thread groove are combined, the leading end member 20 and the piston body 30 are fixed to each other. In this case, an oil passage may be formed inside the leading end member 20.

In the above embodiments, the hydraulic pump or motor 1 operates as a hydraulic pump. The hydraulic pump or motor 1 may operate as a hydraulic motor.

REFERENCE SIGNS LIST

1 HYDRAULIC PUMP (HYDRAULIC PUMP OR MOTOR)
1H HOUSING
2 DRIVE SHAFT
3 PISTON
3H SPACE
4 PISTON SHOE
4A SPHERICAL PORTION
4B LEG PORTION
4C INTERNAL CHANNEL
5 SWASH PLATE
5A SLIDING SURFACE
6 CYLINDER BLOCK
6H CENTER HOLE
6S CYLINDER
7 VALVE PLATE
8 BOLT
9 RETAINER
10 CONNECTION MEMBER
11 CYLINDRICAL PORTION
12 TAPERED PORTION
13 END FACE
14 END FACE
15 SCREW HOLE
16 BEARING
20 LEADING END MEMBER
21 PROTRUSION
22 INSERTION PORTION
23 STORAGE SPACE
23T SLOPE
24 DEFORMABLE PORTION
24N NOTCH
25 THROUGH HOLE
25D STEPPED PORTION
26 SURFACE
27 OPPOSED SURFACE
28 OUTER SURFACE
29 OIL PASSAGE
29A CHANNEL GROOVE
29B CHANNEL GROOVE
30 PISTON BODY
31 LEADING END SURFACE
32 INTERNAL SPACE
33 INTERNAL CHANNEL
34 OPENING
35 INLET
36 OUTLET
40 SPHERICAL PORTION
61 COMMUNICATION PORT
61H OPENING
62 OPPOSED SURFACE
71 INTAKE PORT
71H INTAKE PASSAGE
72 DISCHARGE PORT
72H DISCHARGE PASSAGE
CX CENTRAL AXIS
RX ROTATION AXIS

The invention claimed is:

1. A piston comprising:
a piston body including an internal space;
a leading end member including an insertion portion placed in the internal space and a protrusion protruding from a leading end surface of the piston body,
wherein the leading end surface is placed around an opening of the piston body connected to the internal space, and the leading end member has an opposed surface facing the leading end surface; and
an oil passage disposed between the leading end surface and at least a part of the opposed surface and between an inner surface of the internal space and at least a part of an outer surface of the insertion portion,
wherein an outer shape of the protrusion is larger than that of the insertion portion and extends beyond the piston body.

2. The piston according to claim 1,
wherein the protrusion has a surface inclined to approach a central axis while getting farther from the leading end surface in an axial direction parallel to the central axis of the piston body.

3. The piston according to claim 1,
wherein the protrusion has a surface placed inside an outer periphery of the piston body in a radiation direction of a central axis of the piston body.

4. The piston according to claim 1,
wherein the leading end member has a density less than or equal to a density of the piston body.

5. A piston comprising:
a piston body including an internal space;
a leading end member including an insertion portion placed in the internal space and a protrusion protruding from a leading end surface of the piston body; and
a connection member placed in the internal space and connected to the insertion portion,
wherein the insertion portion includes a deformable portion placed around the connection member and configured to deform outward in a radiation direction of a central axis of the piston body upon contact with the connection member.

6. The piston according to claim 5,
wherein the connection member has an outer surface at least a part of which is inclined to approach a central axis of the piston body while getting closer to the leading end surface in an axial direction parallel to the central axis.

7. The piston according to claim 5,
wherein the leading end member includes a through hole parallel to the central axis of the piston body,
the connection member includes a screw hole formed with a thread groove, and
the piston comprises a bolt including a shaft placed in the through hole and a leading end including a thread connected to the thread groove.

8. The piston according to claim 5,
wherein the connection member has a density less than or equal to a density of the piston body.

9. A hydraulic pump or motor comprising:
a cylinder block including a cylinder in which the piston according to claim 1 is placed;
a piston shoe disposed at a base end of the piston; and
a swash plate configured to support the piston shoe.

10. A piston comprising:
a piston body including an internal space;
a leading end member including an insertion portion placed in the internal space and a protrusion protruding from a leading end surface of the piston body,
wherein the leading end surface is placed around an opening of the piston body connected to the internal space, and the leading end member has an opposed surface facing the leading end surface; and an oil passage disposed between the leading end surface and at least a part of the opposed surface and between an inner surface of the internal space and at least a part of an outer surface of the insertion portion, wherein the leading end member includes a through hole parallel to the central axis of the piston body.

* * * * *